United States Patent [19]

Shimada et al.

[11] 3,933,299

[45] Jan. 20, 1976

[54] BACKWARD OPENABLE CONTAINER WITH A DEVICE TO PREVENT ITS INNER TRAY FROM BEING SLIPPED DOWNWARD

[76] Inventors: Katsuji Shimada, 11-10, Midorigaoka, Ashiya; Katsuyuki Shimada, 13-46-203, 2-chome, Nigawa-kita, Takarazuka, both of Japan

[22] Filed: July 5, 1974

[21] Appl. No.: 485,866

[52] U.S. Cl. ..... 229/20; 229/44 CB

[51] Int. Cl.[2] ..... B65D 5/66

[58] Field of Search ..... 229/20, 19, 44 CB

[56] References Cited

UNITED STATES PATENTS

| | | | |
|---|---|---|---|
| 439,993 | 11/1890 | Bailey | 229/20 |
| 2,597,810 | 5/1952 | Myers | 229/19 |
| 3,102,675 | 9/1963 | Schrom | 220/20 |
| 3,132,790 | 5/1964 | Capuccio | 229/20 |
| 3,204,852 | 9/1965 | Capuccio | 229/20 |
| 3,231,170 | 1/1966 | Robinson | 229/20 |
| 3,311,283 | 3/1967 | Shimada et al. | 229/20 |
| 3,773,245 | 11/1973 | Meyers et al. | 229/20 |
| 3,773,247 | 11/1973 | Mueller | 229/44 CB |

*Primary Examiner*—Davis T. Moorhead
*Attorney, Agent, or Firm*—Allison C. Collard

[57] ABSTRACT

A container having continuous pieces with a gap in the middle therebetween provided in a lower end section of an outer shell. The container is so constructed that by pushing up an inner tray from the gap, the upper portion thereof can be opened rearwardly, and a device to prevent the inner tray from slipping downwardly.

3 Claims, 8 Drawing Figures

Fig. 1
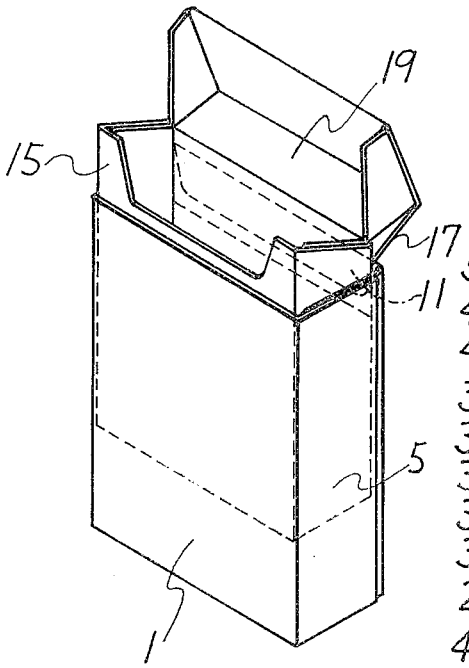
Fig. 3
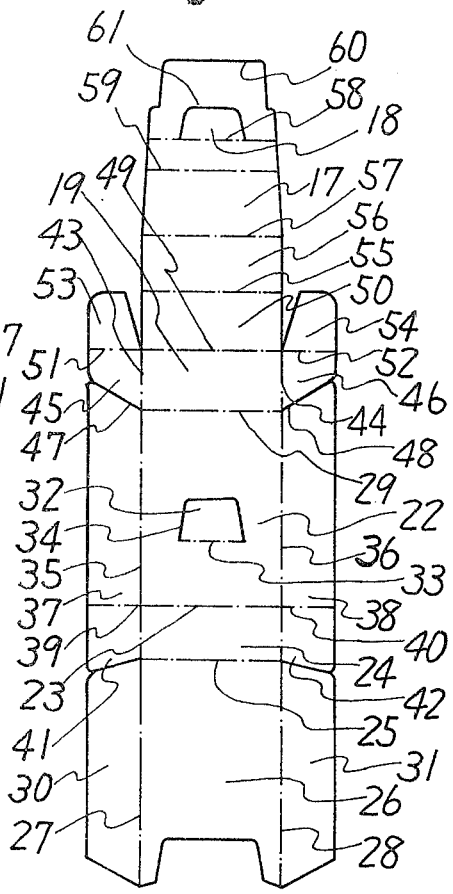
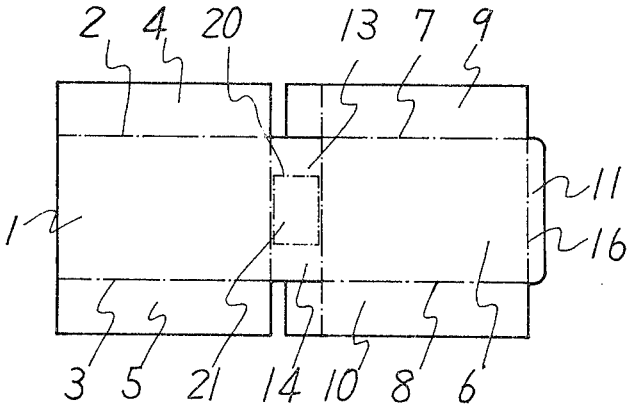
Fig. 2

Fig. 4
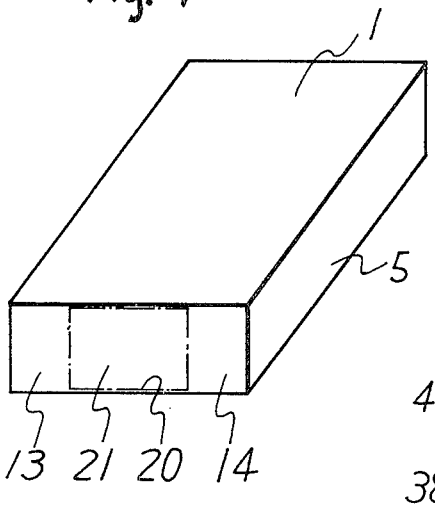
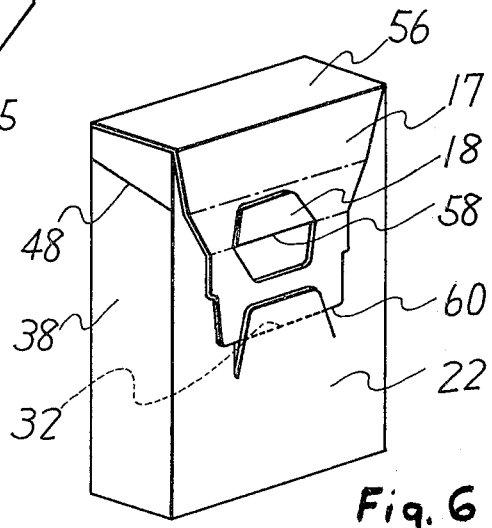
Fig. 6
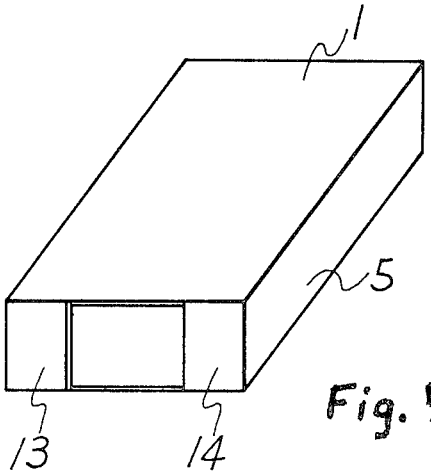
Fig. 5

BACKWARD OPENABLE CONTAINER WITH A DEVICE TO PREVENT ITS INNER TRAY FROM BEING SLIPPED DOWNWARD

OBJECTS OF THE INVENTION

An important object of this invention is to provide a container which is provided with continuous pieces in a lower end section so that even the inner tray which holds heavy objects will not slip downward.

Another object of this invention is to provide a container which is provided in the middle of the lower end portion with a gap, through which a push by the tip of a finger will raise the inner tray to a position where its upper portion can be opened rearwardly.

A still other object of this invention is to make it easier to place the inner tray into the outer shell in the manufacturing process by placing an inner tray forming blank with the contents therein between the folds of the outer shell forming blank and by completing the assembly of the outer shell.

A further object of this invention is to provide the effect of a perfect sealing without requiring any sealing device by closing the gap with a scored piece, which is continuous with continuous pieces, and by pasting the scored piece to the lower end wall of inner tray.

A still further object of this invention is to provide a rearwardly openable container with the most pleasing appearance and operation.

With these and other objects in view, the invention consists of certain novel features of construction as will be more fully described in the claims.

BRIEF DESCRIPTION OF THE DRAWINGS

In the accompanying drawings.

FIG. 1 is a perspective view of the assembled carton in the open position.

FIG. 2 illustrates a properly cut and scored blank from which an outer shell embodying this invention may be formed.

FIG. 3 illustrates a properly cut and scored blank from which an inner tray embodying this invention may be formed.

FIG. 4 is a perspective view of the outer shell with a sealing effect seen from the bottom direction.

FIG. 5 is a perspective view of the outer shell without a sealing effect.

FIG. 6 is a perspective view of the inner tray as seen from the direction of its back wall.

DETAILED DESCRIPTION

Figure 7:
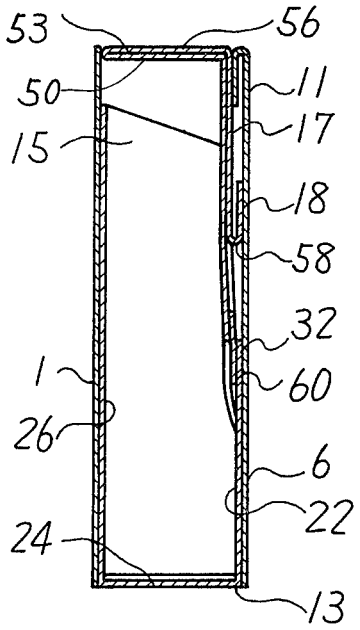
FIG. 7 is a longitudinal sectional view of the assembled carton in the closed position.
Figure 8:
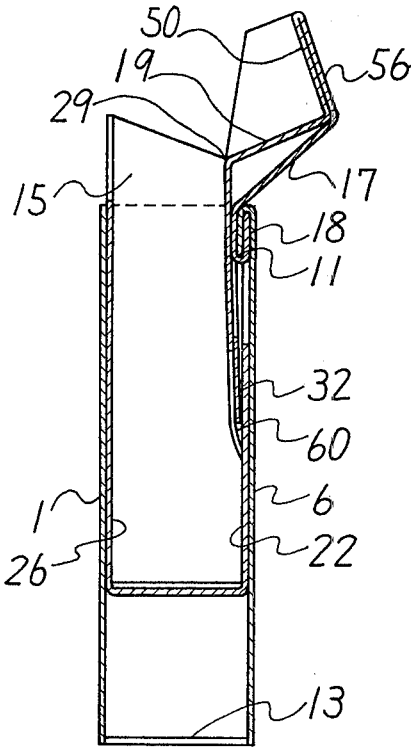
FIG. 8 is a longitudinal sectional view of the assembled carton in the open position.

This invention relates to a rearwardly openable container with a device to prevent its inner tray from slipping downwardly and a method of making the same characterized in that a top wall and a bottom wall of the inner tray are continuous at their respective lower end sections by means of continuous pieces, that the inner tray which is openable backwardly is placed between the folds formed by the top and bottom walls, that a side wall integrally mounted on the top wall and a side wall integrally mounted on the bottom wall are pasted together, and that a set comprising an engaging device is provided on the outer side of the bottom wall of the inner tray and on the inner side of the bottom wall of the outer shell for engaging the outer and inner sides.

There have hitherto been a number of containers in which the upper portion of its inner tray can be opened backwardly. In opening, however, it is necessary to bend it with the tip of a finger, or an engaging device for opening the upper portion appears outside to and injures its appearance. In addition to these defects, any conventional container has a defect in that its inner tray will slip in the downward direction out of its rectilinear outer shell when heavy objects such as chocolates are contained therein. Besides, it is particularly difficult when an automatic mechanical machine is used, to manufacture a rectilinear outer shell first, and then to fit an inner tray tightly, but yet slidably in the rectilinear outer shell. Moreover, for this kind of container there has been no packing which can also serve as a sealing. Thus, it has been necessary to install a separate sealing device.

The container of this invention removes all defects of conventional containers. The container of this invention prevents its inner tray from slipping downwardly. Its engaging device which does not appear outside is capable of opening the upper portion of its inner tray. Its packing has also the effects of sealing without any additional separate sealing device. Its inner tray is not fitted in its outer shell after the formation of the latter, but the inner tray is placed in the outer shell forming blank while the latter is in the process of being made into the outer shell. Thus, the assembling process of the inner tray and the outer shell is quite easy. It may be said, therefore, that the effect of this invention is quite remarkable.

Referring to the drawing, a top wall 1, of the outer shell is integrally connected with side walls 4 and 5 on its two sides through fold lines 2 and 3 respectively. A bottom wall 6 is integrally connected with side walls 9 and 10 through fold lines 7 and 8 respectively. An extension 11 is integrally provided at the upper portion of the bottom wall 6 through a fold line 16. The extension 11 is folded down inwardly being resilient at its fold. The width of the extension 11 may be equal to the entire width of the back wall 6, or to only a central portion of the width thereof. Continuous pieces 13 and 14 connect the lower portion of the top wall 1 and that of the bottom wall 6 respectively. Between the continuous pieces 13 and 14 there is a gap for pushing up the inner tray. The length of the continuous piece is equal to the thickness of the outer tray.

In assembling the outer tray forming blank, the side walls 4 and 9, and the side walls 5 and 10 are adhered together.

A rearwardly openable inner tray is generally indicated by the numeral 15. A flap 17 is provided alongside the bottom wall of the inner tray 15 from the upper portion 19 thereof. On the outer surface of the flap 17 there is a cut portion which is bent back upwardly at a fold line 58 to form a hook 18. The extension 11 of the outer shell and the hook 18 are so arranged as to be engageable. When the inner tray is moved up within the outer shell, the flap 17 is pulled downward so as to open the upper portion of the inner tray backwardly.

Besides, it is possible to close the gap between continuous pieces 13 and 14 temporarily by making them continuous and to make scored lines 20 to form a scored piece 21 separable from the continuous pieces 13 and 14 along the scored lines 20, and to stick the inner surface of the piece 21 to the outer surface of a lower end wall 24 of the inner tray 15 with paste. Unless the piece 21 is separated from the continuous pieces 13 and 14 around the scored lines 20, the inner tray will not move within the outer shell and so the upper portion of the inner tray will not open. Thus, this may also function as a sealing device.

A detailed description of the inner tray will now be made with reference to FIG. 3.

A bottom wall 22 is integrally connected at its lower end with a lower end wall 24 through a fold line 23. A top wall 26 is integrally provided at the front end of the lower end wall 24 through a fold line 25. Outer side walls 30 and 31 are integrally provided respectively on both sides of the top wall 26 through fold lines 27 and 28. A tongue 32 is defined from the wall 22 by means of a fold line 33 and cut 34. The tongue 32 points in the upward direction of the bottom wall. Inner side walls 37 and 38 are integrally provided respectively on back sides of the bottom wall 22 through fold lines 35 and 36. Inner lower end pieces 41 and 42 are integrally provided respectively at the lower ends of the inner side walls 37 and 38 through fold lines 39 and 40. The upper portion 19 of the inner tray is integrally provided at the upper end of the bottom wall 22 through a fold line 29. The upper portion is capable of bending backward. Upper side walls 45 and 46 are integrally provided on both sides of the upper portion 19 of the inner tray through fold lines 43 and 44. The upper side walls 45 and 46 are separated from the upper ends of the inner side walls 37 and 38 by means of cuts 47 and 48. A lid wall 50 is integrally provided at the upper end of the upper portion 19 of the inner tray through a fold line 49. Inner lid pieces 53 and 54 are integrally provided at the upper end of the upper side walls 45 and 46 through fold lines 51 and 52. An upper lid wall 56 is integrally provided at the top end of the lid wall 50 through a fold line 55. The upper lid wall 56 is so provided as to be superimposed upon the upper surface of the lid wall 50. The flap 17 is integrally provided at the lower end of the upper lid wall 17 through a fold line 57. At the lower end of the flap 17 there is provided a hook 18 defined by the fold line 58 and a cut 61 from the flap 17. The said hook 18 is bent outwardly and upwardly. A flexible fold line 59 is provided halfway on the flap 17. The numeral 60 indicates the lower end of the flap 17.

In assembling the container of this invention, the lower end wall 24 is folded at the fold line 23 of the inner tray at right angles to the bottom wall 22. The inner side walls 37 and 38 are folded at the fold lines 35 and 36 at right angles to the bottom wall 22. The inner lower end pieces 41 and 42 are folded at the fold lines 39 and 40 so as to be in contact with the inner surface of the lower end wall 24. The top wall 26 is folded at the fold line 25 so as to be in parallel with the bottom wall 22. The upper side walls 30 and 31 are folded at the fold lines 27 and 28 so as to be in contact with the outer surface of the inner side walls 37 and 38.

Next, the upper side walls 45 and 46 are folded at the fold lines 43 and 44 at right angles to the upper portion 19 of the inner tray. The lid wall 50 is folded at the fold line 49 at right angles to the upper portion 19 of the inner tray. The inner lid pieces 53 and 54 are folded at the fold lines 51 and 52 to be placed on the upper surface of the lid plate 50. Next, the upper lid wall 56 is folded at the fold line 55 so as to cover the lid wall 50. Thus, the inner lid pieces 53 and 54 are placed between the lid wall 50 and the upper lid wall 56. The flap 17 is folded downward at the fold line 57. The lower end 60 of the flap 17 (FIG. 6) is placed between the bottom wall 22 and the tongue 32. Then, the hook 18 is folded backwardly and upwardly, and the inner tray is completely assembled.

Next, the extension 11 in the outer shell forming blank as shown in FIG. 2 is folded back at the fold line 16 so as to be placed over the bottom wall 6. The inner tray 15 with its contents therein is placed on the bottom wall 6. Then, the outer tray is folded in such a way that the inner surfaces of the continuous pieces 13 and 14 of the outer shell are in contact with the lower end wall 24, and the inner surface of the top wall 1, of the outer shell is in contact with the top wall 26 of the inner tray. Next, the side walls 9 and 10 are folded at the fold lines 7 and 8 so as to form right angles to the bottom wall 6. Similarly, the sidewalls 4 and 5 are folded at the fold lines 2 and 3, and are placed in contact with the outer surface of the side walls 9 and 10, and are pasted together.

For the outer shell having the scored piece 21 between the continuous pieces 13 and 14, the piece 21 is pasted with the lower surface of the lower end wall 24 of the inner tray.

In this way, the inner tray is placed within the outer shell forming blank, and then the side walls are pasted together. Then, when the outer shell is completely assembled, the inner tray is already therein. Thus, the container of this invention is capable of dispensing with a difficult operation after a complete assembling of the inner tray and the outer shell. Thus, it becomes technically easier to manufacture the containers of this invention. Besides, this invention makes it possible to manufacture containers mechanically and very efficiently.

In assembling the container of the invention, the flap 17, FIG. 6 is so arranged as to be in contact with the outer surface of the bottom wall 22 of the inner tray and to lie between the bottom wall 6 of the outer shell and the bottom wall 22 of the inner tray. Besides, the lower end 60 of the flap 17 is always placed between the tongue 32 and the bottom wall 22. Thus, this arrangement has the function of controlling the inner tray not to go up too far. Thus the assembling of the container is completed. By placing articles into the inner tray so as when it is placed in the outer shell, the container will already have its contents therein when both the inner tray and the outer shell are completely assembled. Thus, this method is very efficient.

In taking packed contents out of a container, where the container originally has a gap within scored line 20 in the lower end portion, one has only to push up the lower end wall 24 of the inner tray with a finger through the gap. Then, the inner tray will move up inside of the outer shell and a position will eventually be reached where the hook 18 of the inner tray engages with the extension 11 of the outer tray. Thus, if one continues to push up the inner tray, the flap 17 will be pulled downward by this engagement, and the lid portion is bent rearwardly at the fold line 29. Thus, the contents can be taken out of the rearwardly bent portion. If the inner tray is pushed up too far, the inner tray may be pushed out of the outer shell in the case of conventional container. With the container of this application, however, the lower end 60 of the flap 17 engages with the tongue 32 to prevent the inner tray from being pushed up any farther. What is more, two continuous pieces 13 and 14 at the lower end portions of the outer shell support the inner tray sufficiently enough to prevent the inner tray from being slipped downward out of the outer shell.

Furthermore, in the case of a container in which a gap between the continuous pieces is closed by means of the scored piece 21 surrounded by the scored lines 20, and in which the piece 21 is pasted with the lower surface of the lower end wall 24, the seal cannot break unless the piece 21 is separated at the scored lines 20. Thus, it can be opened only when piece 21 is separated at the scored lines 20, and the portion of the piece 21 which has been adhered with the lower end wall 24 is pushed up. Thus, the presence of the piece 21 ensures the completion of a complete sealing.

What is claimed is:

1. A carton having an automatically opening cover, said carton comprising:

an outer shell having an unapertured shell bottom wall which extends the full length of said outer shell;

an extension attached to the upper portion of said shell bottom wall of said outer shell and bent downwardly along an inside surface thereof;

an inner tray slidably disposed inside said outer shell and having a tray bottom wall and a tray top wall disposed parallel to one another and connected by a tray lower end wall, and an upper portion hinged to said tray bottom wall defining a lid wall having a flap extending from a rear portion thereof downwardly between said tray bottom wall and said shell bottom wall, said flap having a free lower end;

said tray bottom wall of said inner tray having a first cutout defining an upwardly directed tongue pointing towards and overlapping said free lower end of said flap;

said flap having a second cutout and forming a hook, the latter being folded and pointing in an upward direction of said upper portion of said inner tray and engagingly overlapping said downwardly bent extension of said outer shell;

said outer shell having a shell top wall, said shell top wall and said shell bottom wall being disposed parallel to one another, said shell top wall and said shell bottom wall having lower portions thereof;

two continuous pieces connecting said lower portion of said shell top wall to said lower portion of said shell bottom wall, said two continuous pieces being formed with a gap in a middle of said two continuous pieces; and said tray lower end wall being disposed adjacent said continuous pieces of said outer shell and adjacent said gap, whereby the inner tray may be pushed upwardly within said outer shell by pressing said tray lower end wall through said gap in said continuous pieces.

2. The backwardly openable container as recited in claim 1 further comprising:

a scored piece operatively connected by score lines to said continuous pieces and removably closing said gap until separated from said continuous pieces by means of said score lines; and said scored piece is pasted to said tray lower end wall, whereby when said scored piece is pushed upwardly by pressure relative to said continuous pieces of said outer shell, said scored piece will be separated at said score lines to permit said inner tray to be pushed upwardly by a person's finger.

3. The backwardly openable container as recited in claim 2 wherein said extension is substantially longer than the width of said hook.

* * * * *